US006371866B1

(12) United States Patent
Rivera

(10) Patent No.: US 6,371,866 B1
(45) Date of Patent: Apr. 16, 2002

(54) COMPACT GOLF CLUB SET

(76) Inventor: Duane F. K. Rivera, 348-B Krukowski Rd., Honolulu, HI (US) 96819

( * ) Notice: Subject to any disclaimer, the term of this patent is extended or adjusted under 35 U.S.C. 154(b) by 0 days.

(21) Appl. No.: 09/536,114

(22) Filed: Mar. 27, 2000

(51) Int. Cl.[7] ..... A63B 53/02; A63B 53/16; A63B 53/06

(52) U.S. Cl. ..... 473/288; 473/306; 473/307

(58) Field of Search ..... 473/288, 296, 473/298, 299, 306, 307, 295, 308, 309; 203/315.1, 315.2, 579

(56) References Cited

U.S. PATENT DOCUMENTS 3,170,691 A * 2/1965 Pritchard
3,829,092 A * 8/1974 Arkin
4,021,038 A 5/1977 Kettleson
4,253,666 A * 3/1981 Murphy
4,375,847 A * 3/1983 Picco
4,664,382 A 5/1987 Palmer et al.
4,674,747 A 6/1987 Mazzocco et al.
5,282,619 A 2/1994 Napolitano et al.
D358,187 S 5/1995 Simomds
5,431,265 A * 7/1995 Yoo
5,588,921 A * 12/1996 Parsick
5,765,691 A 6/1998 Hall
5,792,006 A 8/1998 Hesser
6,110,055 A * 8/2000 Wilson

* cited by examiner

*Primary Examiner*—Stephen Blau
(74) *Attorney, Agent, or Firm*—Michael I. Kroll

(57) ABSTRACT

A compact golf club set is provided having a complete set of thirteen golf club heads, two club shafts, and two club handles, all attractively positioned and retained, in a unique briefcase-style carrying case, which provides ready access to golf shoes, towels, balls and tees. The various club shafts and club handles combine to form a long and a short club assembly, corresponding with a typical wood and a typical putter, respectively. The club shafts couple directly to the club heads without an intervening shank, which allows a complete thirteen club head set to be compactly and efficiently positioned in receptacles in the carrying case.

8 Claims, 7 Drawing Sheets

COMPACT GOLF CLUB SET

BACKGROUND OF THE INVENTION

1. Field of the Invention

Figure 1:
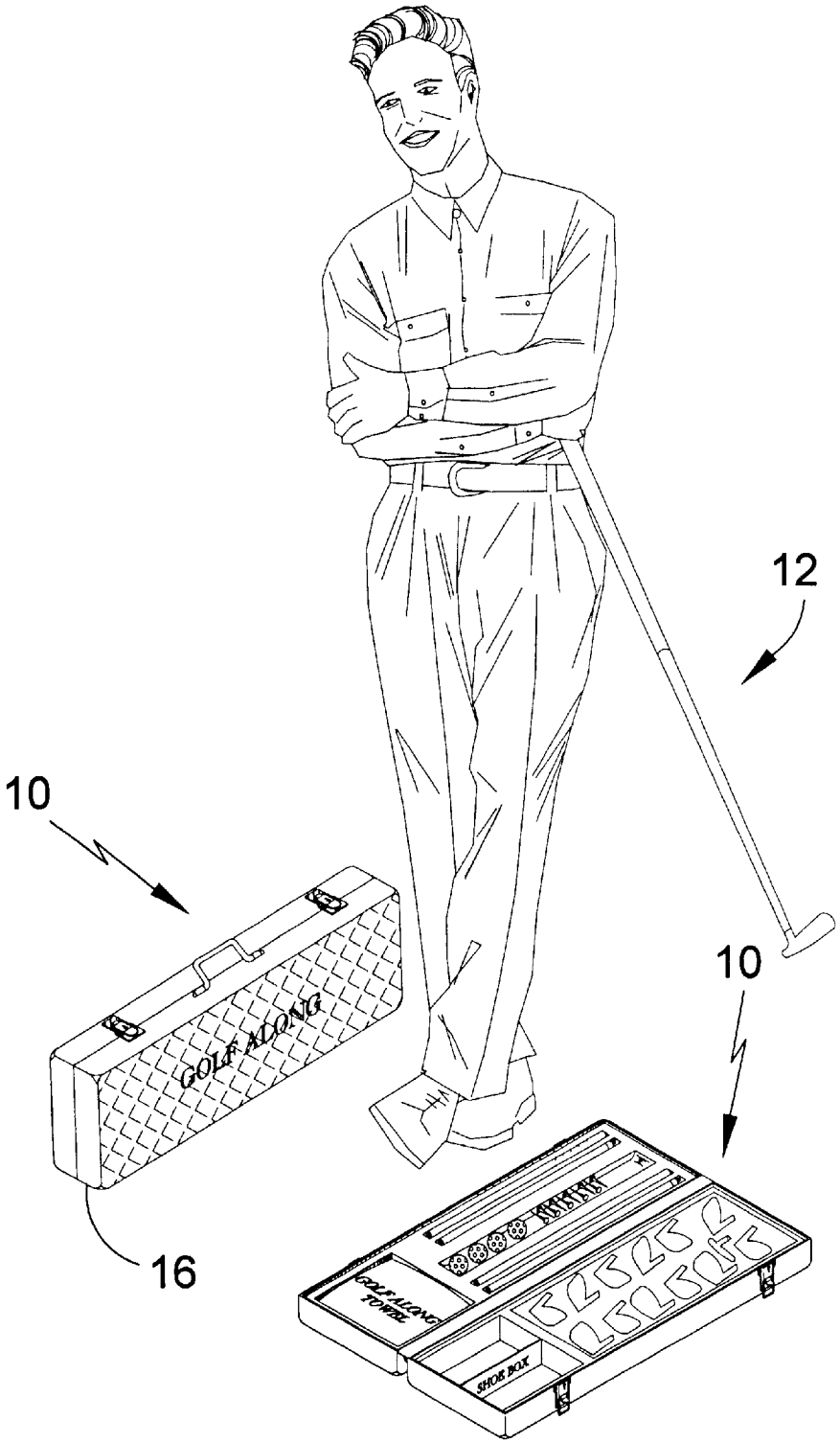

The present invention relates generally to golf clubs and golf club transportation and, more specifically, to a compact golf club set having a set of golf club heads, two club shafts, and two club handles, all attractively positioned and retained, in a unique carrying case, which provides ready access to golf shoes, towels, balls and tees.

The various club shafts and club handles combine to form both a long and a short club assembly, corresponding with a typical driver wood and a typical putter, respectively. The club shafts couple directly to the club heads without an intervening shank, which allows a complete thirteen club head set to be compactly and efficiently positioned in receptacles in the carrying case.

Coupling is accomplished by threaded connection of the club head, club shaft and club handle, with a threaded sleeve providing a tightening enhancement at the coupling of the club shaft to the club handle. The direction of the threads in the coupling of such components is chosen such that tightening of the couplings is enhanced by the force of the club head striking the ball. The directions so chosen for the right-hand club heads are reversed for the left-hand club heads.

The case includes one or more compartments which store and secure golf balls and golf tees, such that they remain in place when the case is opened. Additional compartments are provided for other accessories, including golf shoes and a golf towel.

2. Description of the Prior Art

There are collapsible and compact golf clubs and golf club storage devices. Typical of these is U.S. Pat. No. 5,765,691 issued to Hall on Jun. 16, 1998.

Another patent was issued to Palmer on May 12, 1987, as U.S. Pat. No. 4,664,382. Yet another U.S. Pat. No. 4,021,038 was issued to Kettleson on May 3, 1977, and still yet another was issued on Aug. 11, 1998, to Hesser as U.S. Pat. No. 5,792,006.

Another patent was issued to Napolitano on Feb. 1, 1994, as U.S. Pat. No. 5,282,619. Yet another U.S. Pat. No. 5,029,860 was issued to Ehrich on Jul. 9, 1991, and still yet another was issued on Jun. 23, 1987, as U.S. Pat. No. 4,674,747 to Mazzocco. A design patent, U.S. Pat. No. Des.358,187, was issued to Simonds on May 9, 1995.

U.S. Pat. No. 5,765,691

Inventor: Jeffrey L. Hall

Issued: Jun. 16, 1998

A traveling golf club kit which enables a user to easily transport a set of golf clubs. In its broadest context the present invention includes a collapsible golf bag and a set of clubs, wherein each of the clubs has an assembled configuration and a disassembled configuration. The various components of the present invention, and the manner in which they interrelate, will be described in greater detail hereinafter.

U.S. Pat. No. 4,664,382

Inventor: Richard J. Palmer

Issued: May 12, 1987

A set of golf clubs has a detachable shaft portion such that a whole set of clubs can be utilized with a single top shaft element which can be firmly but removably attached to a shortened shaft portion provided with each club head. A carrying bag is provided for the clubs and shaft, this bag having a plurality of tubular receptacles, one for each club or shaft. A row of such receptacles is attached to each of the sides of the bag. The receptacles in each row have successively greater lengths and are arranged to form a stepped configuration so that the clubs will when installed in their receptacles have their heads in different levels in the bag for easy selection. A third row of receptacles are attached to each other and at one end of the row connected by a flexible connector to the rear of the bag so that the entire row will pivot both to facilitate selection of the clubs and to provide a compact assembly for carrying. The receptacles have caps on their ends with resilient finger portions to hold the clubs in a central position therein.

U.S. Pat. No. 4,021,038

Inventor: Russell W. Kettleson

Issued: Feb. 9, 1976

A golf cart and club assembly which can be collapsed to occupy only a fraction of the volume of conventional, commercial bag and club assemblies.

U.S. Pat. No. 5,792,006

Inventor: Hesser

Issued: Aug. 11, 1998

The disclosed collapsible golf club shaft is formed of a conventional stepped one-piece tubular golf shaft having diameters progressing from a large ID and OD end to a smaller ID and OD end, being cut in two at the end of one cylindrical axial sections next to the larger axial section, allowing the two pieces to be telescoped together as inner and outer pieces, and shifted then between a collapsed position compactly nested together and an extended operative position with only endmost stepped sections of the pieces yet overlapped at a separable connection between the pieces. A screw can be extended through wall structure openings and threaded into a reinforcing structure inside the inner piece at the connection for locking the pieces together in the extended operative position. A golf club formed from this shaft, with a hand grip on the outer piece and a head on the inner piece, at the opposite ends of the extended shaft, can be collapsible to slightly more than half the length of the extended operative club, for compact storage and handling.

A practice golf club has a collapsible adjustable shaft. The golf club includes a club head, a handle, and a shaft. The shaft has a number of telescopic sections that permit the shaft to be adjustable between a fully extended position and a fully collapsed position. The club head is attached to the lowermost shaft section and the handle is attached to the uppermost shaft section. A locking nut and a compression ring permit adjacent sections of the telescopic section to be releasably locked in a fixed position relative to each other at any location between a fully extended position and a fully collapsed position.

U.S. Pat. No. 5,029,860

Inventor: James D. Ehrich

Issued: Jul. 9, 1991

A golf club which includes an overlength shaft which includes telescopically connected tubular shaft members.

The shaft members are shiftable between an extended operative position with the shaft members secured one to the other and a collapsed, inoperative position in which one shaft member fits loosely inside the other.

U.S. Pat. No. 4,674,747

Inventor: Thomas R. Mazzocco

Issued: Jun. 23, 1987

The present invention provides an improved golf club having an adjustable length shaft retractable between fully extended and collapsed positions. In one embodied form, the inventive golf club comprises plural concentric telescopic interlocking tubular sections which produce a friction lock between the tubular sections in a fully extended position. When the inventive club is in a fully collapsed position, the proximate ends of the tubular sections are disposed in relation to one another in sufficient distance to permit grasp of a player's hand about one of the tubular sections, but without the occurrence of pinch between proximate ends of the tubular sections. In another embodiment of the invention, a durable lightweight golf bag is provided which provides a convenient means for carrying the inventive golf clubs and associated golfing equipment. Accordingly, the present invention provides improved golf clubs which are more conveniently retracted in a collapsed position without required specialized tools and which minimize the occurrence of pinch of a player's hand when the club is in a retracted position.

U.S. Pat. No. Des. 358,187

Inventor: Simmons

Issued: May 9, 1995

The ornamental design for a golf club having a collapsible shaft.

while these golf clubs and sets devices may be suitable for the purposes for which they were designed, they would not be as suitable for the purposes of the present invention, as hereinafter described.

SUMMARY OF THE PRESENT INVENTION

A primary object of the present invention is to overcome the shortcomings of the prior art.

Another object of the present invention is to provide a compact golf club set with detachable club heads that have minimal structure beyond the club head, in order to maximize the storage efficiency of the club heads in a unique carrying case.

Yet another object of the present invention is to provide a club handle, club shaft, and removable club heads, wherein the club heads have a vertical portion which is shorter in length than a horizontal portion.

Still another object of the present invention is to provide a compact golf club with removable club heads that screw on to a club shaft in a direction such that the connection tends to tighten when the club head strikes a golf ball.

Still yet another object of the present invention is to provide a compact golf club set having thirteen removable club heads which correspond to a typical set of golf clubs.

Another object of the present invention is to provide a compact golf club set having two club handle and club shaft combinations, which correspond to typical putter and driver lengths.

Yet another object of the present invention is to provide a compact golf club set which includes a unique briefcase-style carrying case, the carrying case storing and securing the components of both a long club assembly, a short club assembly, and thirteen club heads corresponding to the clubs in a typical set of golf clubs.

Still another object of the present invention is to provide a compact golf club wherein a club handle attaches to a club shaft by a first threaded coupling, and then by a threaded sleeve coupling, where the threads in the threaded sleeve coupling are reverse to those in the first threaded coupling.

Another object of the present invention is to provide a compact golf club set having a carrying case which provides for golf accessory storage and retention, including accessories such as golf balls, golf tees, golf shoes, and golf towels.

Yet another object of the present invention is to provide means for coupling, decoupling, transporting, and storing, a club handle, a club shaft, and a set of club heads.

Still yet another object of the present invention is to provide means for enhancing the storage efficiency of a set of club heads in a carrying case.

Additional objects of the present invention will appear as the description proceeds.

The present invention overcomes the shortcomings of the prior art by providing more compact and efficient storage of the components of a compact golf club set. Because no shank or unnecessary vertical extensions of the club heads are present, the club heads can be individually positioned in the carrying case in a highly efficient and compact manner. Such efficiency allows a second club handle and club shaft assembly to be included which provides the needed club assembly length choice to properly utilize the club heads, which range from a putter to the driver wood.

Furthermore, the double coupling of the club shaft to club handle enhances coupling integrity. Similarly, the thread direction at the club head and club shaft coupling is alternated based on the use of either right-hand club heads, or left-hand club heads, such that the coupling tends to tighten as the club head strikes a golf ball.

In all, the present invention provides a more comprehensive solution, compared to prior art, to the need for an attractive, efficient, lightweight, and compact golf club set.

The foregoing and other objects and advantages will appear from the description to follow. In the description reference is made to the accompanying drawings, which form a part hereof, and in which is shown by way of illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 1 is a perspective view of the present invention showing a golfer with both an open and closed compact golf set in use. The closed case is styled like a briefcase and can have a hard or soft exterior surface. When opened the primary contents remain secured within the receptacles and contents provided. Golf club heads are in individually matched receptacles, while short and long club handle and club shaft assemblies are secured in matched channels. A short club assembly is held by the golfer with the putter head being used in such assembly.

Figure 2:
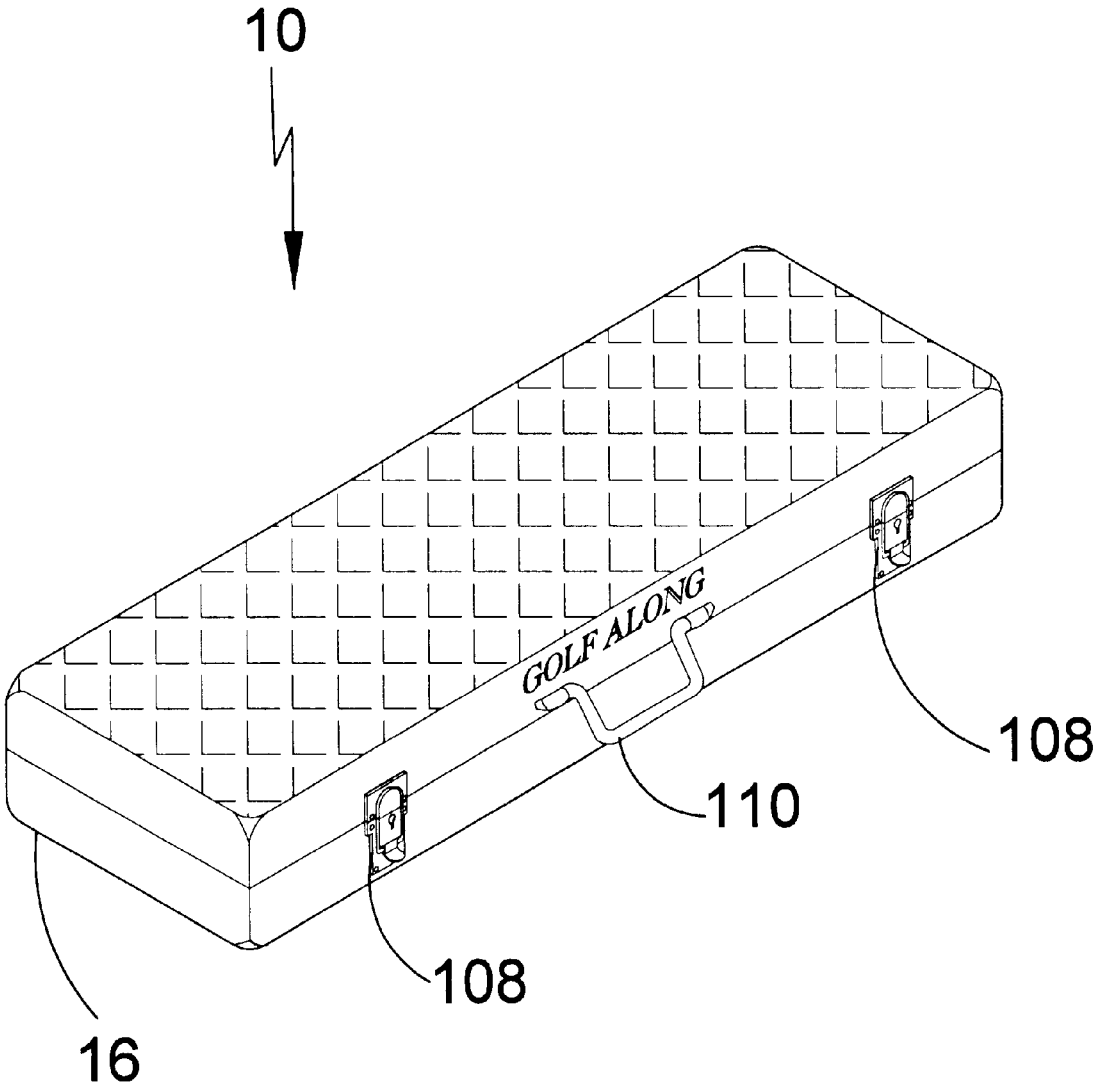

FIG. 2 is a perspective view of the present invention, which more closely shows the closed carrying case. Latches and a carrying handle are shown.

Figure 3:
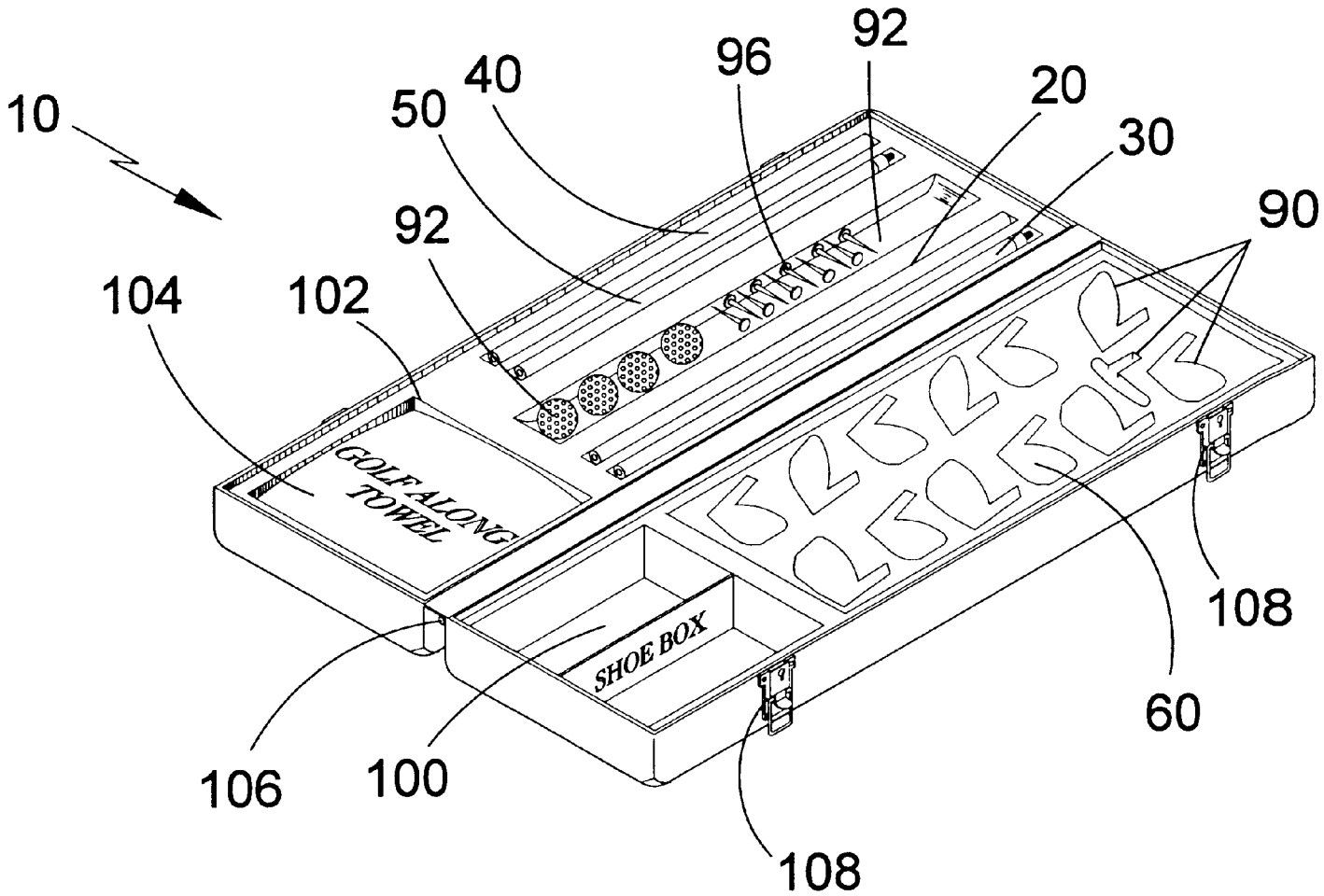

FIG. 3 is a perspective view of the present invention, which more closely shows the open carrying case and the manner which the primary contents are fully displayed and readily accessed. The matched receptacles and club heads are represented, along with the club handle and club shaft channels, and the golf ball and tee compartment. The divided golf shoe compartment is illustrated, as well as, an additional compartment for other golf accessories, such as a golf towel.

Figure 4:
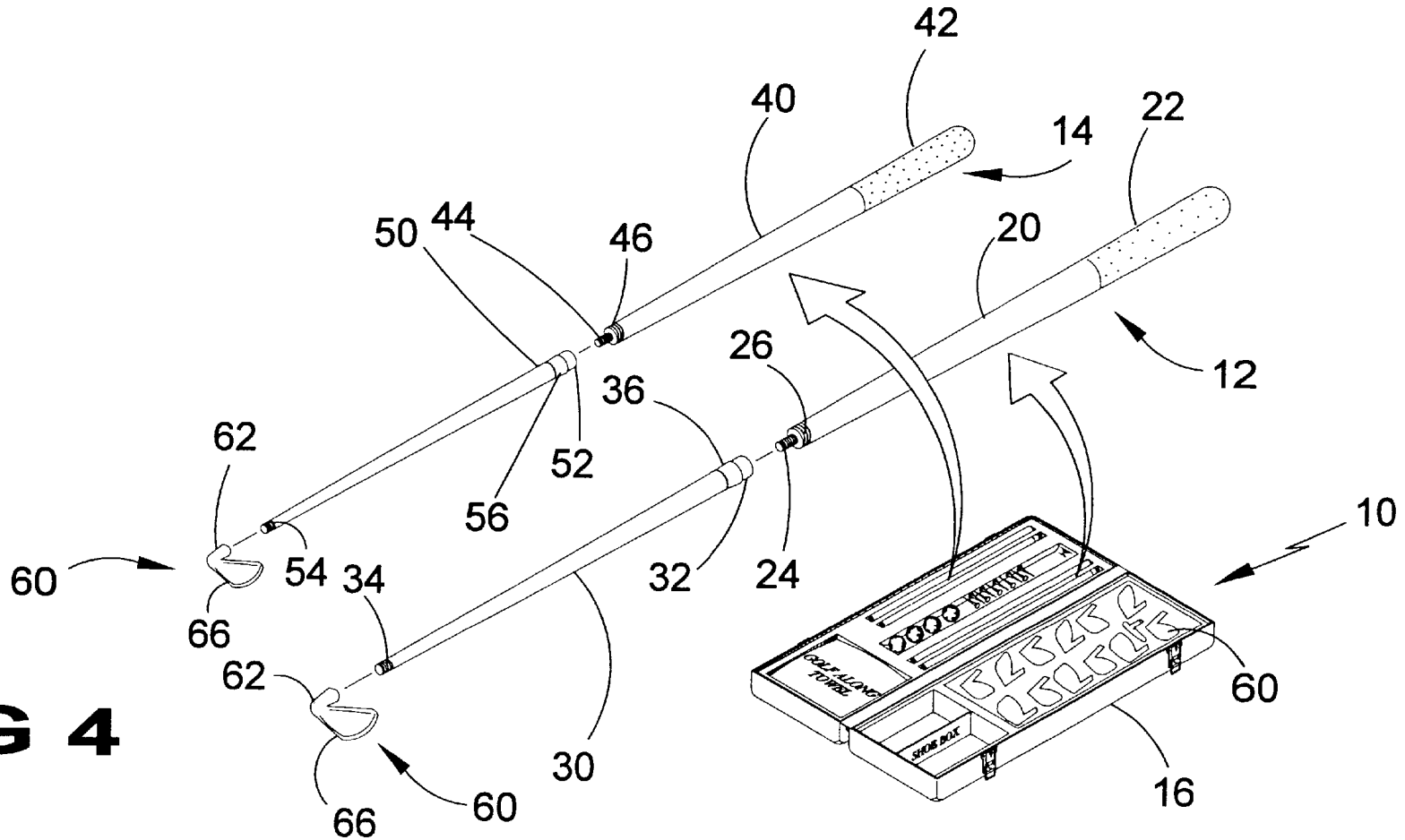

FIG. 4 is a perspective view of the open carrying case and contents, with the club heads, club shafts and club handles, shown in position for coupling, whereby the long club assembly and the short club assembly will be formed. Couplings are accomplished by threaded portions on the club heads, club shafts, and club handles, along with a threaded sleeve on each club shaft which forms a second coupling of the club shaft and club handle, the sleeve threads being reverse from the other threaded couplings.

Figure 5:
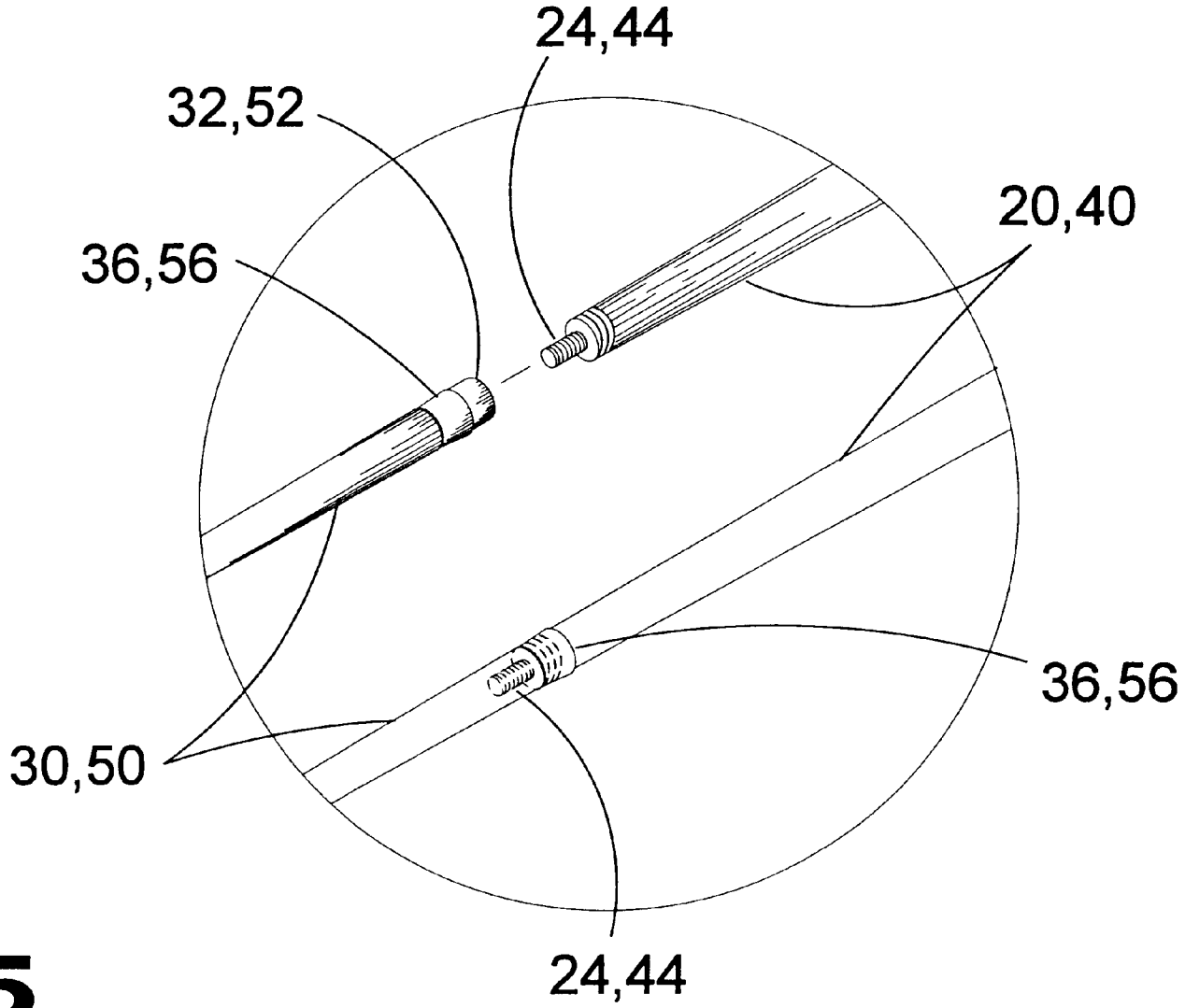

FIG. 5 is a closer perspective view of the club shaft and club handle coupling, both before and after, which is representative of that couple on both the long club assembly and the short club assembly. The position change of the threaded sleeve is depicted, as it moves beyond the end of the club shaft to couple with the appropriate threads on the club handle.

Figure 6:
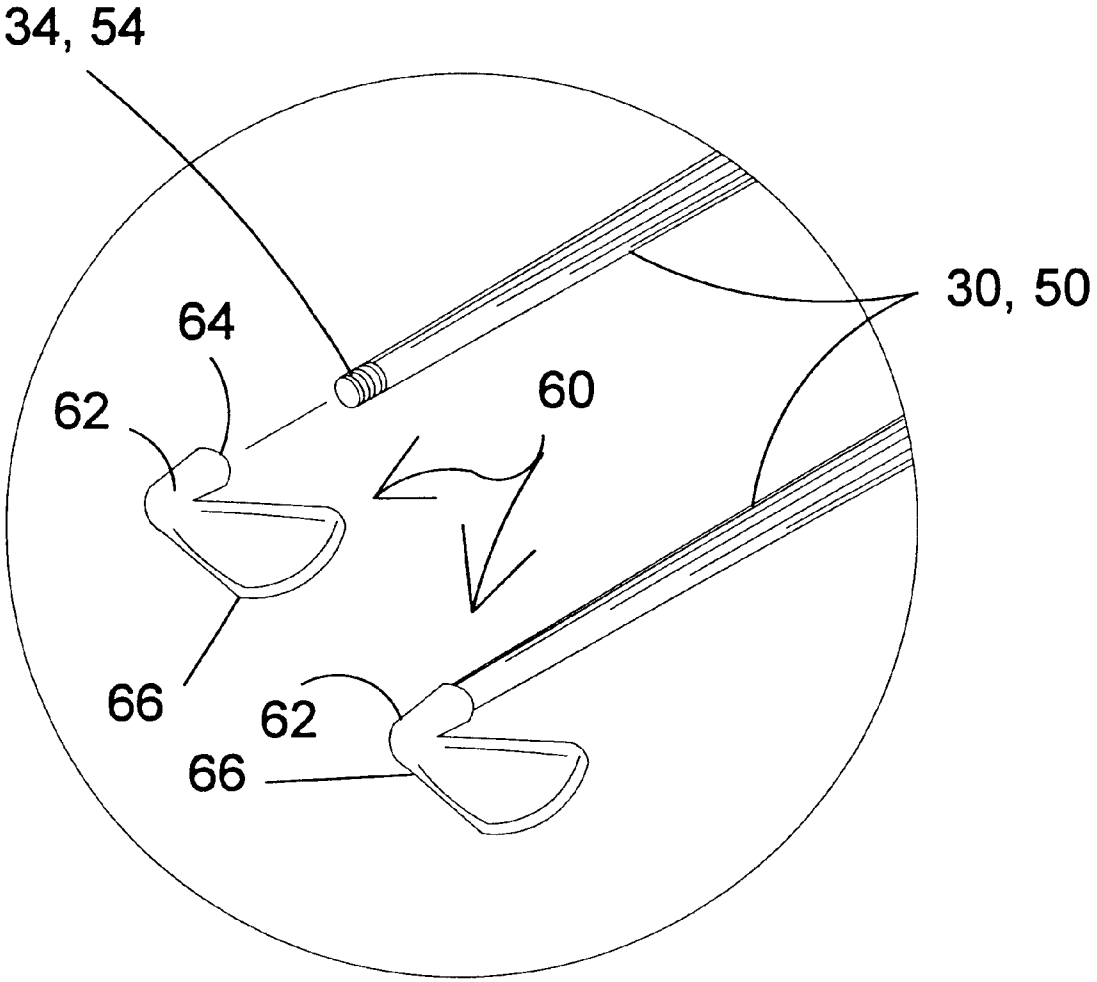

FIG. 6 is a closer perspective view of the club shaft and club head coupling, both before and after, which is representative of that couple on both the long club assembly and the short club assembly. The relationship of the club head vertical portion length and horizontal portion length is evident, the vertical portion length being reduced such that the space requirement for the club head in the carrying case is maximized. For the right-hand club head this threaded coupling has left-hand threads. For the left-hand club head this threaded coupling has right-hand threads.

Figure 7:
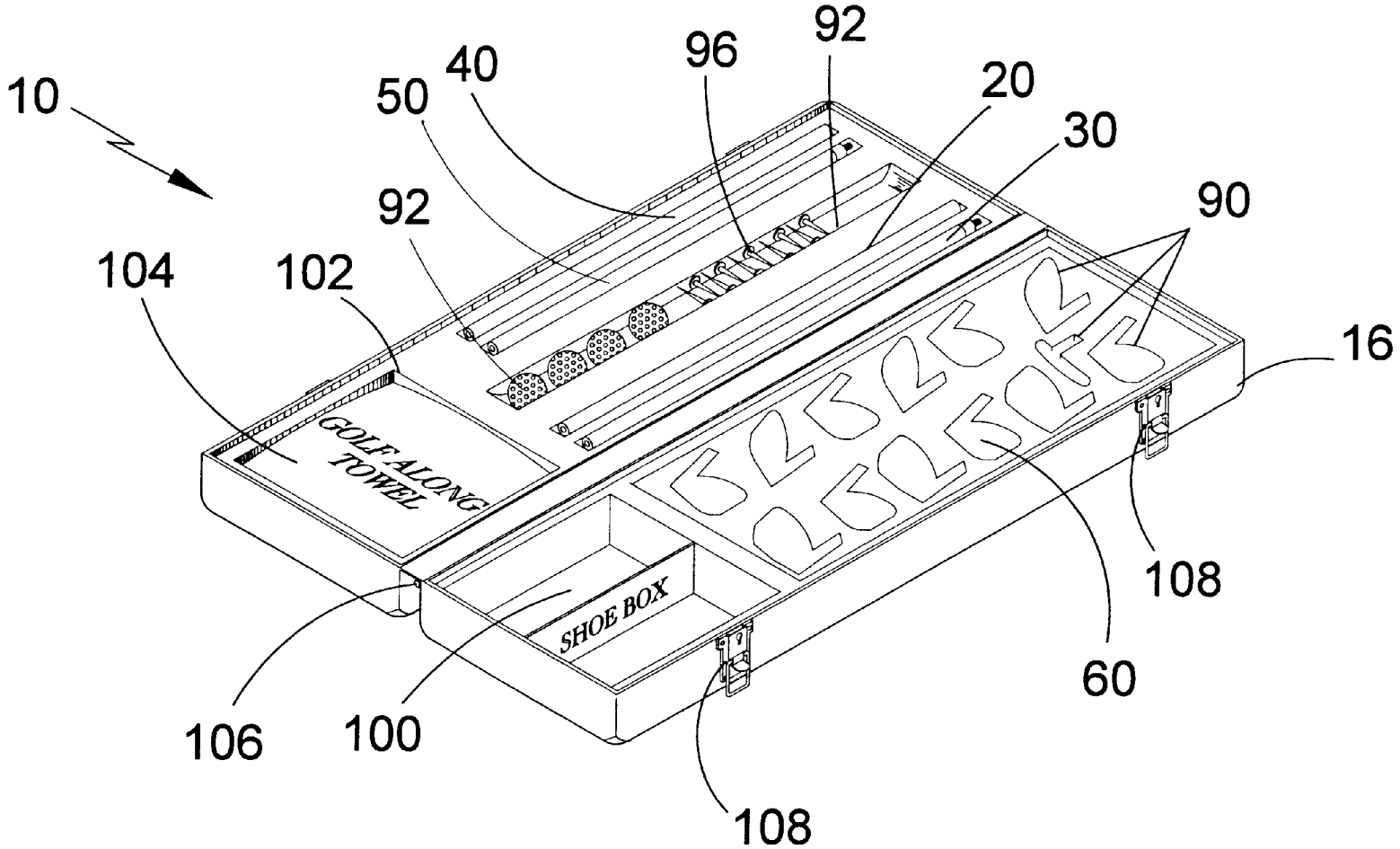

FIG. 7 is an additional perspective view of the open carrying case and the primary contents, showing a reduced width compartment for the golf balls and golf tees, the width chosen such that the sides of the compartment secure both the golf balls and golf tees within such compartment.

DETAILED DESCRIPTION OF THE REFERENCED EMBODIMENT

Turning now descriptively to the drawings, in which similar reference characters denote similar elements throughout the several views, FIGS. 1–7 illustrate the compact golf club set of the present invention indicated generally by the numeral 10.

The complete set 10 is shown in use in FIG. 1. The set 10 includes a long club assembly 12, a short club assembly 14, and carrying case 16, the case 16 being generally rectangular and openable to a substantially horizontal position, displaying, and providing ready access to, the primary contents of the case 16. The case 16 can be soft or hard surfaced.

FIGS. 4–6 depict the manner in which the long and short club assemblies 12,14 are positioned for threaded coupling of the components. The long club assembly 12 includes a long club handle 20, with a grip 22, a first threaded portion 24, and a second threaded portion 26. A long club shaft 30, with a threaded first end 32, a threaded second end 34, and a threaded sleeve 36. The long club shaft threaded first end 32 is threadably coupled to the long club handle first threaded portion 24. When so coupled, the long club shaft threaded sleeve 36 can be slid beyond the end of the long club shaft 30 to couple with the long club handle second threaded portion 26, the threads in this coupling being reverse to the threads in the coupling of the long club shaft threaded first end 32 and long club handle first threaded portion 24.

To complete the long club assembly 12, one of the golf club heads 60, having a vertical portion 62, with interior threads 64, and a horizontal portion 66, is screwed on to the long club shaft threaded second end 34.

Included in the preferred embodiment is a short club assembly 14, including a short club handle 40, with a grip 42, a first threaded portion 44, and a second threaded portion 46. A short club shaft 50, with a threaded first end 52, a threaded second end 54, and a threaded sleeve 56. The short club shaft threaded first end 52 is threadably coupled to the short club handle first threaded portion 54. When so coupled, the short club shaft threaded sleeve 56 can be slid beyond the end of the long club shaft 50 to couple with the short club handle second threaded portion 46, the threads in this coupling being reverse to the threads in the coupling of the short club shaft threaded first end 52 and short club handle first threaded portion 44.

To complete the short club assembly 14, one of the golf club heads 60, having a vertical portion 62, with interior threads 64, and a horizontal portion 66, is screwed on to the short club shaft threaded second end 54.

Although any lengths can be chosen for the long club handle 20, long club shaft 30, short club handle 40, and short club shaft 50, a length of eighteen inches has been chosen for the each of the short club handle 40 and short club shaft 50. This generally corresponds to a normal putter length when in the short club assembly 14. Similarly, a length of twenty inches has been chosen for each of the long club handle 20 and the long club shaft 30, which generally corresponds to a normal driver wood length when in the long club assembly 12.

As particularly shown in FIG. 3, special receptacles 90 are provided which are individually sized and shaped to closely receive and retain each of the thirteen club heads 60 used in a typical set of golf clubs. An additional compartment 92 is provided to store golf balls 94, and can be sized to closely receive and retain golf balls 94, such that the golf balls 94 will be retained as the case 16 is opened, as depicted FIG. 7. Golf tees 96 can also be stored and retained during opening, as shown in FIG. 3 and FIG. 7, with the dimensions of 92 changing as necessary to secure the golf tees 96. A divided compartment 98 is provided to store golf shoes, and another compartment 102 is provided for golf towel 104 storage, as well as, other golf accessories. The case 16 is openable upon hinges 106, is closed using typical latches 108, and can be carried using handle 110.

The short length of the club head vertical portion 62 allows for the most efficient storage of the club heads 60, since club head receptacles 90 can be spaced more closely. A longer vertical portion 62, or the addition of a shank, would cause a significant reduction is this efficiency by requiring substantially more room for the club heads 60 in the case 16. In the preferred embodiment, the club head vertical portion 62 is limited to a length shorter than the club head horizontal portion 66 length. This limitation ensures highly efficient use of available storage area in case 16.

Club heads 60 are available in right-hand or left-hand versions, or a combination of both. As an enhancement to the coupling tightness of a right-hand club head 60, the long and short club shaft threaded second ends 34,54 are left-hand threads. When the right-handed golfer strikes the ball with the right-hand club head 60, the club head 60 tends to rotate clockwise on the long or short club shaft second threaded ends 34,54, thus tending to tighten the threaded coupling.

Similarly, the threaded coupling between the long club shaft threaded first end 32 and the long club handle first threaded portion 24 utilizes left-hand threads. Although to a lesser extent, the force of the ball striking the club head 60, also tends to tighten this coupling. The tightness of this latter coupling is enhanced further by the long club shaft threaded sleeve 36 coupling with the long club handle second threaded portion 26. This coupling utilizes right hand threads, which when being tightened, tends to tighten the underlying coupling. The long club shaft threaded sleeve 36, when coupled, also provides lateral support to the underlying coupling of the long club shaft 30 and the long club handle 20.

Analogous tightening and lateral support effects are realized in the coupling of the short club shaft threaded sleeve 56 with the short club handle threaded second portion 46. This coupling also utilizes right hand threads.

For club assemblies using left-hand club heads 60, the above-described thread directions for all couples in the club assembly are reversed, providing tightening enhancements analogous to those in the right-hand club assemblies.

Although particular dimensions and characteristics of the golf club assemblies and carrying case have been discussed, such dimensions could be varied to suit the requirements of various individuals, including children, youth and adults of both sexes, and the number and arrangement of storage compartments and receptacles in the carrying case can be increased or repositioned, all in accordance with the present invention, and as determined by the intended end use for the overall device, as will occur to those of skill in the art upon review of the present disclosure.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A compact golf club, comprising:

(a) a club head, having a threaded portion;

(b) a club handle, the club handle having a first threaded portion and a second threaded portion, the first threaded portion threads being reverse to the second threaded portion; and (c) a club shaft, the club shaft having a first end, second end, and a sleeve, the club shaft first end having threads for threaded coupling with the club handle threaded portion, the club shaft second end having threads for threaded coupling with the club head threaded portion, the club shaft sleeve having threads, the club shaft sleeve further being slidable along the club shaft such that the club shaft sleeve threads couple with the club handle second threaded portion.

2. The compact golf club of claim 1, wherein the club head is a right-hand club head and the club head threads are left-hand threads.

3. The compact golf club of claim 1, wherein the club shaft first end threads are left-hand threads.

4. The compact golf club of claim 1, wherein the club head is a left-hand club head and the club head threads are right-hand threads.

5. The compact golf club of claim 4, wherein the club shaft first end threads are right-hand threads.

6. The compact golf club of claim 1, wherein the club head further comprises a horizontal and a vertical portion, the threaded portion being on the vertical portion, the vertical portion having a length and the horizontal portion having a length, the vertical portion length being shorter than the horizontal portion length.

7. The compact golf club of claim 1, wherein the number of club heads is two or more.

8. The compact golf club of claim 1, wherein the number of club heads is thirteen, each corresponding with a club head in a typical golf club set.

* * * * *